US005537947A

United States Patent [19]

Couture et al.

[11] Patent Number: 5,537,947

[45] Date of Patent: Jul. 23, 1996

[54] EXPENDABLE UNDERWATER VEHICLE

[75] Inventors: John R. Couture, Somerset; Alan T. Hudson, Mattapoisett; Michael J. Balboni, Wareham, all of Mass.; Mark C. Manning, Portsmouth, R.I.; Patrick J. Kelly, Wareham; Brian J. Gallagher, Rochester, both of Mass.

[73] Assignee: Sippican, Inc., Marion, Mass.

[21] Appl. No.: 327,657

[22] Filed: Oct. 24, 1994

[51] Int. Cl.[6] ..... F42B 19/36

[52] U.S. Cl. ..... 114/20.1; 89/1.11

[58] Field of Search ..... 114/20.1, 20.2, 114/21.3, 22; 89/1.11; 102/407; 434/12, 13, 25

[56] References Cited

U.S. PATENT DOCUMENTS

| | | | |
|---|---|---|---|
| 2,975,396 | 3/1961 | Mueller | 340/5 |
| 3,180,295 | 4/1965 | Niederer | 114/20.1 |
| 3,609,671 | 9/1971 | Webster et al. | 340/3 E |
| 3,676,802 | 7/1972 | Murphree et al. | 340/384 E |
| 3,921,559 | 11/1975 | Wells, Sr. | 114/20.1 |
| 4,198,703 | 4/1980 | Huisveld, Jr. et al. | 367/1 |
| 5,247,894 | 9/1993 | Haisfield et al. | 114/20.1 |

OTHER PUBLICATIONS

MK39 EMATT brochure, published by Sippican, Inc. about 1993, two pages.

*Primary Examiner*—Charles T. Jordan
*Assistant Examiner*—Theresa M. Wesson
*Attorney, Agent, or Firm*—Testa, Hurwitz & Thibeault

[57] ABSTRACT

An expendable underwater vehicle for use in training naval forces in anti-submarine warfare in ocean waters, including shallow waters, is between about three to five feet in length and about five inches in diameter, and it includes various improvements which make successful operations in shallow ocean waters, and improved operation in all ocean waters, possible. The improvements include a one-piece nose cup which allows the expendable underwater vehicle to be air launched into shallow water, a scuttle plug which allows water to fill the expendable underwater vehicle after the vehicle is expended and drops to the bottom of the ocean, and rudders and elevators of increased surface area which improve controllability of the vehicle in the water.

34 Claims, 10 Drawing Sheets

EXPENDABLE UNDERWATER VEHICLE

STATEMENT REGARDING FEDERALLY SPONSORED RESEARCH

This invention was made with government support under Contract No. N00024-91-C-6127 awarded by the Department of the Navy. The government has certain rights in the invention.

FIELD OF THE INVENTION

This invention relates to expendable underwater vehicles, and more particularly, expendable underwater vehicles adapted for operation in relatively shallow water.

BACKGROUND OF THE INVENTION

An expendable underwater vehicle, such as the Expendable Mobile ASW (Anti-Submarine Warfare) Training Target (EMATT) which is available from Sippican, Inc. of Marion, Mass., is used to train naval forces in the detection, localization, tracking, and/or attacking of a submarine in the ocean (i.e., to train naval forces in anti-submarine warfare). After being launched into the ocean, the expendable underwater vehicle "swims" a pre-programmed underwater course as it acoustically simulates a submarine. The naval forces use acoustics to detect, localize, track, and/or attack the simulated submarine. After a specified time, currently about three hours, the internal batteries of the expendable underwater vehicle become exhausted, and the vehicle drops to the bottom of the ocean. If the water is relatively shallow (e.g., less than about 100 feet), the expended vehicle at the ocean bottom can be washed onto the shore by the action of the tide and currents.

The expendable underwater vehicle can be launched into the ocean from either a surface ship or an aircraft. When launched by a surface ship, the expendable underwater vehicle is dropped into the water from a short distance thereabove such that the impact is minimal and no damage results. In an aircraft launch, the expendable underwater vehicle cannot simply be dropped into the water because the impact with the water typically will damage the vehicle. Additional hardware is used in an aircraft launch to help the vehicle survive the impact with the water. The additional hardware, known as the air launch assembly, includes a two-piece nose cup assembly, a windflap, a harness, and a parachute.

To air launch the expendable underwater vehicle, it is fitted with the air launch assembly. The two-piece nose cup goes over the nose of the vehicle and is held in place by straps of the harness which also attach to the parachute. The parachute is packaged underneath the windflap and the entire vehicle is packaged in a sonobuoy launch container. The vehicle can be launched from the aircraft either using a launching tube that accepts the sonobuoy launch container and automatically, upon command, ejects the vehicle from the container, or by manually removing the vehicle from the sonobuoy launch container and dropping (launching) the unit through a launching tube or other opening in the aircraft. After the vehicle is launched from the aircraft, the windflap separates from the vehicle and deploys the parachute. The parachute opens and decelerates the vehicle such that the vehicle enters the water nose-first and along its longitudinal axis. At or just after water impact, the force causes the two-piece nose cup assembly to separate into its two halves, each of which is forced away from the vehicle as the vehicle continues to descend into the water. The two-piece nose cup assembly: (i) serves as a packaging spacer to contain the vehicle properly in the sonobuoy launch container prior to launch; (ii) keeps the parachute attached to the vehicle after air launch and until or just after water impact; (iii) impacts the water first and thereby helps to protect the vehicle from damage which can be caused by the impact of water entry; and (iv) separates into its two halves at or just after water impact.

After separation of the two halves of the two-piece nose cup, which occurs at or relatively soon after water impact, the vehicle continues to dive into the water at a relatively fast speed such that it can reach a depth of about 100 feet or more before it stops diving. One or both of the halves of the nose cup can contact the rear section (shroud) of the vehicle as the vehicle dives past the separated halves. Because the vehicle is traveling at a high speed as it enters the water (e.g., about 60 miles per hour), the contact can cause serious damage to the shroud which can result in poor performance or even an inoperable vehicle.

The two-piece nose cup assembly can be useful when air launching the vehicle for deep water (e.g., from about 150 to 600 feet) operation. For shallow water (e.g., from about 50 to 150 feet) operation, the vehicle typically must be launched by a surface ship and cannot be air launched with the two-piece nose cup assembly due to the depth to which the vehicle typically descends when air launched with the two-piece nose cup assembly.

Training and practice in the detection, localization, tracking, and/or attacking of a submarine in the ocean (i.e., training and practice in anti-submarine warfare) in relatively shallow waters (e.g., about 150 feet deep or less) can be important to naval forces.

SUMMARY OF THE INVENTION

The invention relates to an expendable underwater vehicle for use in training naval forces in anti-submarine warfare in ocean waters, including shallow waters. The vehicle is between about three to five feet in length and about five inches in diameter, and it includes various improvements which make successful operation in the ocean waters possible.

In one aspect, the invention features a one-piece nose cup assembly which allows the expendable underwater vehicle to be air launched into and operated in relatively shallow waters such as water less than about 150 feet deep and, more particularly, water about 100 feet deep or less. It also generally allows for a more reliable air launch in all water depths. The one-piece nose cup assembly, like the vehicle, is expendable.

In another aspect, the invention involves a scuttle plug which allows water to fill the expendable underwater vehicle after the vehicle is expended and drops to the ocean bottom. When filled with water, the expended vehicle typically will not wash onto the shore by the action of the tide and currents, thereby reducing the likelihood of recovery of the expended vehicle and resultant exposure to the hazards associated with a partially discharged lithium battery. In addition, once the sea water is within the expended vehicle, the water depletes the energy of the battery, thereby further reducing the hazard associated with a partially discharged lithium battery in the event the expended vehicle is inadvertently recovered.

In still another aspect of the invention, the expendable underwater vehicle has rudders and elevators of larger surface area to improve controllability of the vehicle in the water by overcoming any out-of-straightness condition of the vehicle which can result from the shock of an air launch and/or hydrostatic pressures.

The foregoing and other objects, aspects, features, and advantages of the invention will become more apparent from the following description and from the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DESCRIPTION

Figure 1:
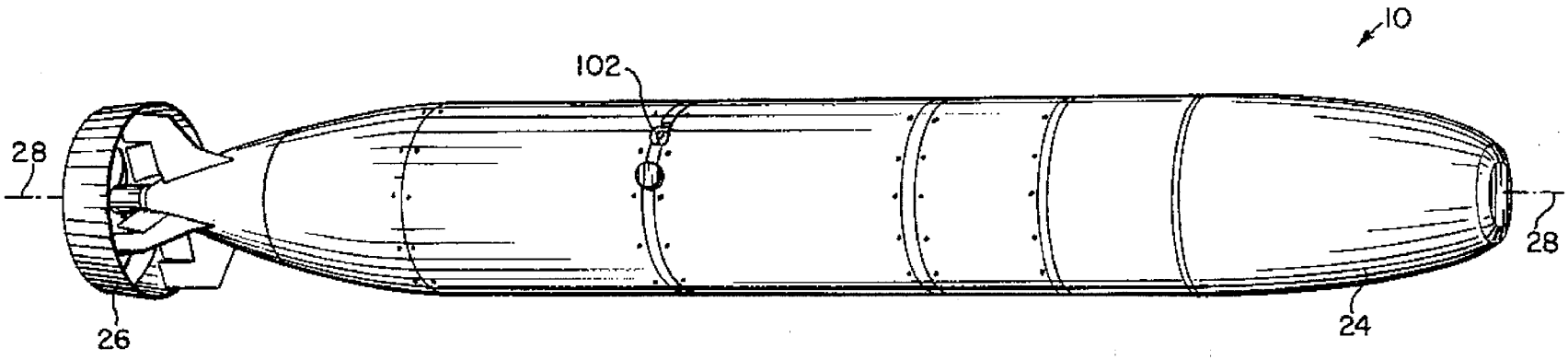
FIG. 1 is a perspective view of an expendable underwater vehicle.
Figure 2:
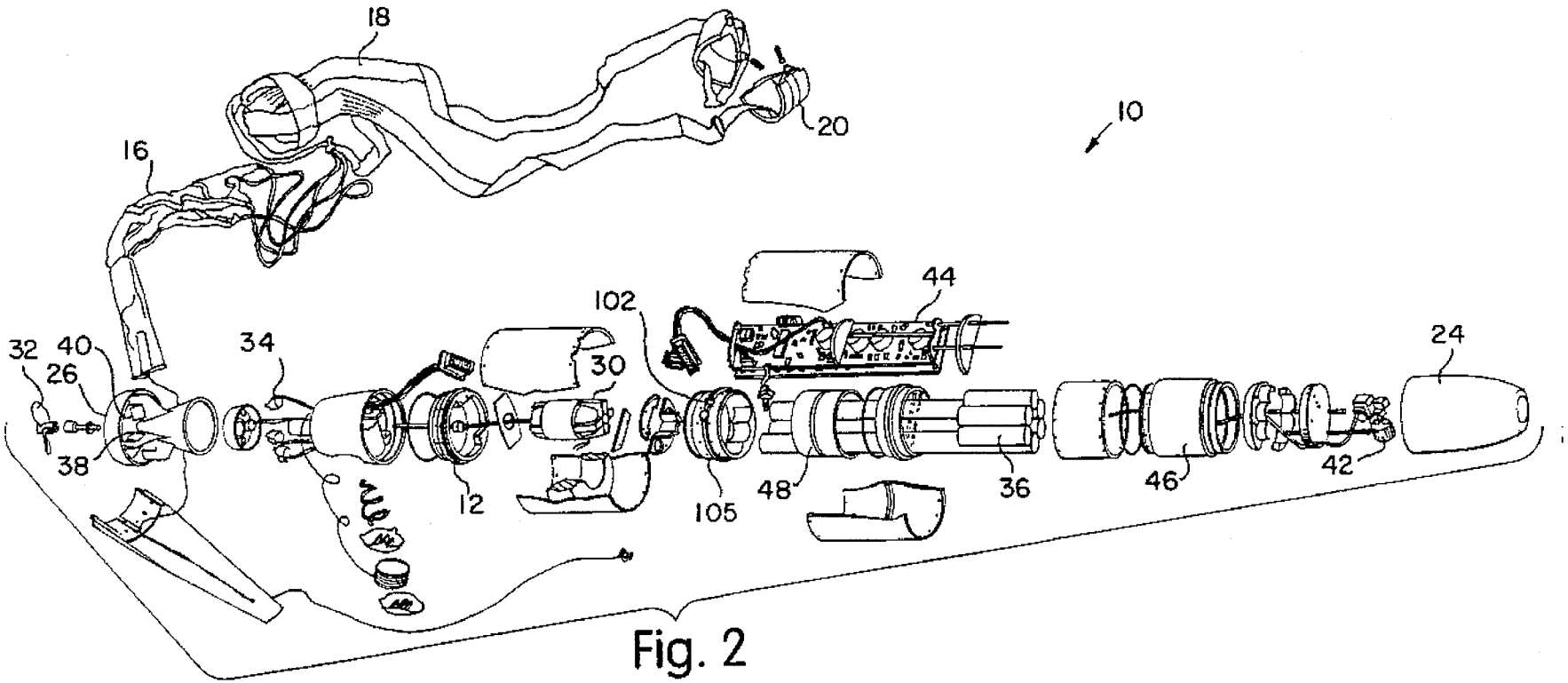
FIG. 2 is an exploded perspective view of the expendable underwater vehicle of FIG. 1 and a two-piece nose cup for use therewith.

Referring to FIGS. 1 and 2, an expendable underwater vehicle 10, such as an Expendable Mobile ASW (Anti-Submarine Warfare) Training Target (EMATT) which is available from Sippican, Inc. of Marion, Mass., is a battery-powered, self-propelled unit which is about three feet long, about five inches in diameter at its thickest point, and about twenty-five pounds in weight. It can range up to about five feet in length. In ASW training exercises, the vehicle 10 is used to simulate a submarine, and it performs a three-hour pattern with varying headings and depths. After being launched into the water, the vehicle 10 turns on and "swims" when a pressure sensor 12 mounted on the hull confirms that the negatively buoyant vehicle 10 is below a specified depth, currently thirty feet.

The vehicle 10 includes a nose 24 at a front end and a shroud 26 at a rear end. Between the nose 24 and the shroud 26 is a generally watertight compartment which houses a DC motor 30 for driving a propeller 32, a guidance and control subsystem for implementing a preprogrammed course for the vehicle in the ocean by controlling the motor 30 and solenoids 34 to cause the vehicle to follow the course, a signal processing subsystem, and a battery pack 36 for supplying power to the signal processing subsystem, the guidance and control subsystem, the motor 30, and the solenoids 34. The battery pack 36 preferably includes one or more lithium batteries, although in general other power sources can be used. The solenoids 34 are actuators which move elevators 38 and rudders 40 at the command of the guidance and control subsystem. The guidance and control subsystem includes a fluxgate compass 42, the pressure sensor 12, the solenoids 34, and electronics 44. The signal processing subsystem simulates a submarine by generating signals representative of the submarine and causing corresponding acoustic signals to be transmitted into the ocean. The signal processing subsystem includes the electronics 44, a forebody projector 46, and at least one midbody projector 48. The forebody projector 46 is an acoustic transducer which, under the control of the electronics 44, receives acoustic interrogations from an external source (e.g., from a sonobuoy) and then transmits acoustic signals representative of echoes which the submarine would return. The forebody projector 46 thus is an active echo receiver/repeater. The midbody projectors 48 are acoustic transducers which, under the control of the electronics 44, generates "noise" which simulates the sound of the running submarine. The midbody projectors 48 thus generate a passive acoustic signature of the simulated submarine.

The vehicle 10 can be launched either from a surface ship by manually dropping it into the water or from an aircraft by using additional hardware. In a conventional configuration, the additional hardware used in an air launch includes a windflap 14, a parachute 16, a harness 18, and a two-piece nose cup assembly 20. In accordance with one aspect of the invention, the two-piece nose cup assembly 20 is replaced with a one-piece nose cup 22 (FIGS. 3A–3F) for air launching into relatively shallow waters such as water about 150 feet or less in depth and, more particularly, water about 100 feet or less in depth. The one-piece nose cup 22 also improves the reliability of air launches in all water depths.

With either the two-piece nose cup assembly 20 or the one-piece nose cup 22, the vehicle 10 is air launched from an aircraft by loading it into and then firing it out of a sonobuoy launcher or from a gravity tube on the aircraft. Prior to loading the vehicle 10 into the sonobuoy launch container, the cup 20 or 22 is placed over the nose 24, and the harness 18 is releasably secured to the cup and extends on either side of the vehicle 10 along its length to the shroud 26. The parachute 16 is tucked in around the shroud 26 and then the windflap 14 is put in place such that the entire assembly fits into the sonobuoy launch container. Once the vehicle 10 is launched out of the sonobuoy launch container and into the air, the windflap 14 deploys the the parachute 16 and, in so doing, the windflap 14 separates from the vehicle 10 while the vehicle 10 is in flight. The deployed parachute 16 then decelerates the vehicle 10 and causes it to enter the water nose-first and along its longitudinal axis 28.

In the conventional air launch configuration which uses the two-piece nose cup assembly 20, while the vehicle 10 is in flight, the two halves of the two-piece nose cup assembly 20 are held together over the nose 24 by a release band. This release band also helps to secure the harness 18 to the cup assembly 20 while the vehicle 10 is in flight. Upon water impact, a plunger in the face of the cup assembly 20 is depressed by the force of the impact, and the release band is thereby released allowing the two halves of the cup assembly 20 to separate. The cup assembly 20 bears the brunt of the impact, which impact typically is strong enough to damage the nose 24 if the nose 24 is unprotected (e.g., if the cup assembly 20 is not fitted over the nose 24). After water impact, the vehicle 10 continues to drive into the water and the two halves of the cup assembly 20 are shed alongside the vehicle 10 and left behind. As the two-piece nose cup assembly 20 separates and is left behind, the harness 18 and the parachute 16 also are left behind.

Referring to FIGS. 3A–3F, 4, and 5, when the one-piece nose cup 22 according to the invention is used in an air launch, the vehicle 10 enters the water with the same orientation as described previously but the cup 22 remains on the nose 24 for a longer period of time after water impact. Because the cup 22 is formed of a single piece of material, it does not separate into halves upon impact with the water. By staying fitted over the nose 24 for a longer period of time after water impact as compared to the two-piece nose cup assembly 20, the one-piece nose cup 22 causes the vehicle 10 to decelerate quicker and then stop driving into the water at a depth less than about 150 feet and, more particularly, at a depth about 100 feet or less and, even more particularly, at a depth between about 20 to 30 feet. Because the cup 22 inhibits the vehicle 10 from driving beyond about 50 feet into the water, use of the cup 22 allows the vehicle 10 to be air launched into and operated in relatively shallow waters such as water less than about 150 feet deep and, more particularly, water about 100 feet deep or less.

Upon water impact, a plunger in the face 50 of the one-piece nose cup 22 depresses due to the force of the water on the face 50, and a release band 52 (FIGS. 3E and 4), which is releasably secured around the cup 22 to hold the harness 18 thereto while the vehicle 10 is in flight in the air, is thereby released allowing the harness 18 and the parachute 16 to fall away from the cup 22 and the vehicle 10. The one-piece nose cup 22 remains on the nose 24 of the vehicle 10 through water entry and initial deceleration in the water. After the vehicle 10 has slowed (e.g., to about five to ten miles per hour), well past the most dynamic stages of the air launch, the cup 22 falls away from the nose 24. The one-piece nose cup 22 is expendable (i.e., it typically is left in the ocean and not recovered or reused). The various components associated and used with the cup 22 also are expendable. In the disclosed embodiment, the cup 22 is in fact pushed off of the nose 24 by an ejector spring 54 (FIGS. 3B and 5) after the vehicle 10 has slowed sufficiently to allow the force of the spring 54, together with the weight of the nose cup 22, to overcome the hydrodynamic force of the water against the face 50 of the cup 22. The speed of the vehicle 10 in the water at which the spring force together with the cup weight exceed the water force is about five to ten miles per hour. The one-piece nose cup 22 is made of a material which gives it sufficient weight such that it separates from the nose 24 at the proper water depth (i.e., at about 50 feet or less below the surface of the water and, more particularly, at a depth between about 20 to 30 feet) to allow air launching of the vehicle 10 into shallow water such as water less than about 150 feet deep and, more particularly, water about 100 feet deep or less. The material from which the cup 22 is made also must be sufficiently rigid to withstand the impact of the water on the face 50 of the cup 22 as the vehicle enters the water at about sixty miles per hour. In the disclosed embodiment, the cup 22 is made of aluminum, although any material which meets the above-stated weight and structural integrity requirements may be used.

After the one-piece nose cup 22 comes off of the nose 24 of the vehicle 10, the vehicle 10 typically is vertical (i.e., its longitudinal axis 28 typically is perpendicular to the surface of the water). In the disclosed embodiment, the guidance and control subsystem of the vehicle 10 will not start the motor 30 to begin the preprogrammed course until the vehicle 10 has reached a predetermined depth such as about sixty feet. The pressure sensor 12 informs the guidance and control subsystem when the predetermined depth has been reached. In general, once the vehicle 10 reaches the predetermined depth, the vehicle 10 is horizontal (i.e., its longitudinal axis 28 is parallel to the surface of the water). The danger of starting the motor 30 when the vehicle 10 is not horizontal or substantially horizontal is that the vehicle 10 will spin out of control.

The one-piece nose cup 22 eliminates many problems associated with the conventional two-piece nose cup assembly 20. For example, the one-piece nose cup 22 does not travel the length of the vehicle 10 as the vehicle 10 drives into the water, and therefore the cup 22 cannot and does not ever damage the shroud 26 when it separates from the nose 24. In fact, when the cup 22 separates from the nose 24, the cup 22 falls down towards the ocean floor in the opposite direction of the shroud 26. Also, with the use of the cup 22, the vehicle 10 can be air launched into and operated in shallow water.

The bottom of the one-piece cup 22 includes a recess 56 (FIG. 3C) for receiving the spring 54 when the cup 22 is held tight against the nose 24. The cup 22 is held tight against the nose 24: (i) prior to air launch while in the sonobuoy launch container and during flight after the air launch but before water impact by the harness 18 which attaches to the shroud 26 at the rear end of the vehicle 10 and to the cup 22 at the front end of the vehicle 10 and (ii) after water impact by the force of the water against the face 50 of the cup 22 until the force of the spring 54 together with the weight of the cup 22 exceed the hydrodynamic force of the water on the cup 22 as the vehicle slows down and the cup 22 is pushed off of the nose 24. The recess 56 includes two holes 58, 60 for receiving two pins 62, 64 at the end of the spring 54.

Figure 3A:
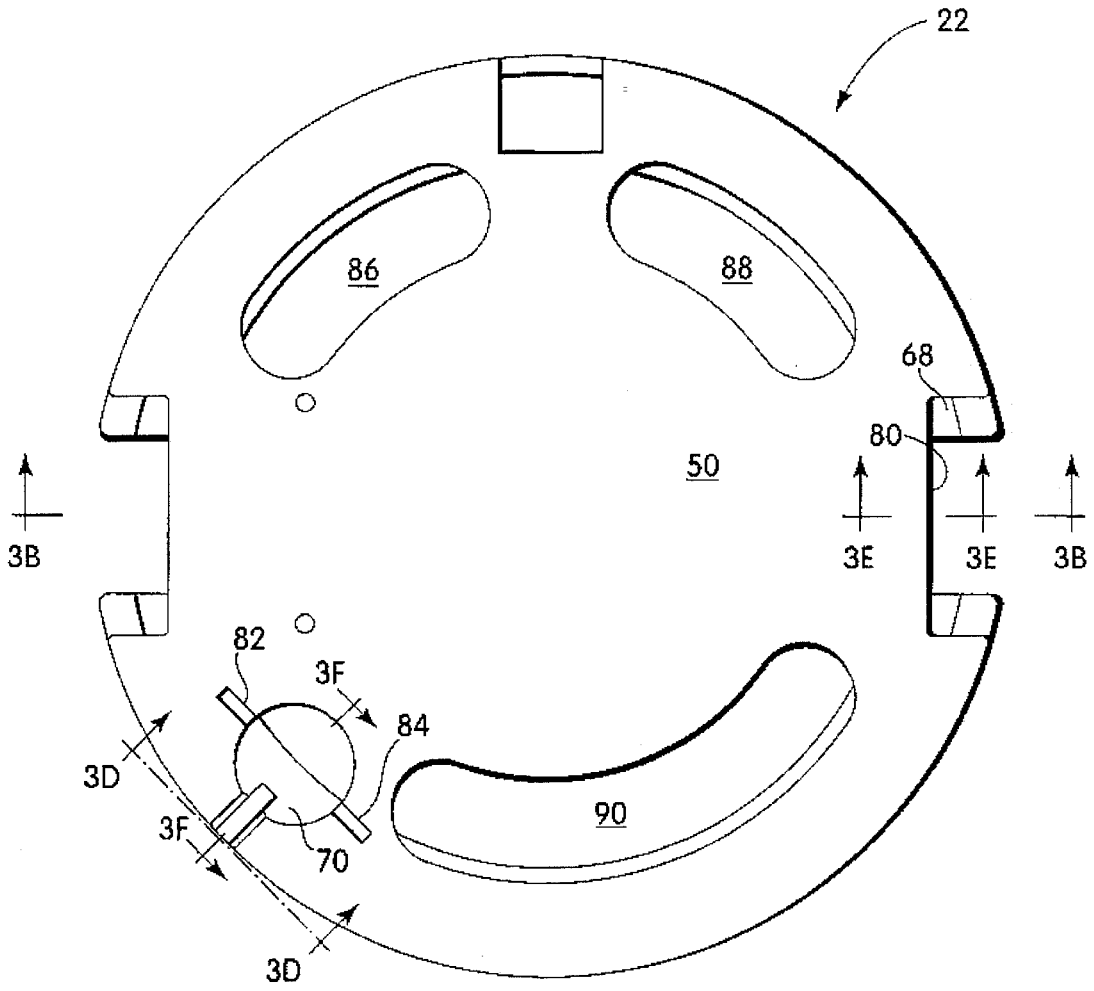
FIG. 3A is a top view of a one-piece nose cup for use with the expendable underwater vehicle of FIG. 1 according to the invention.
Figure 3B:
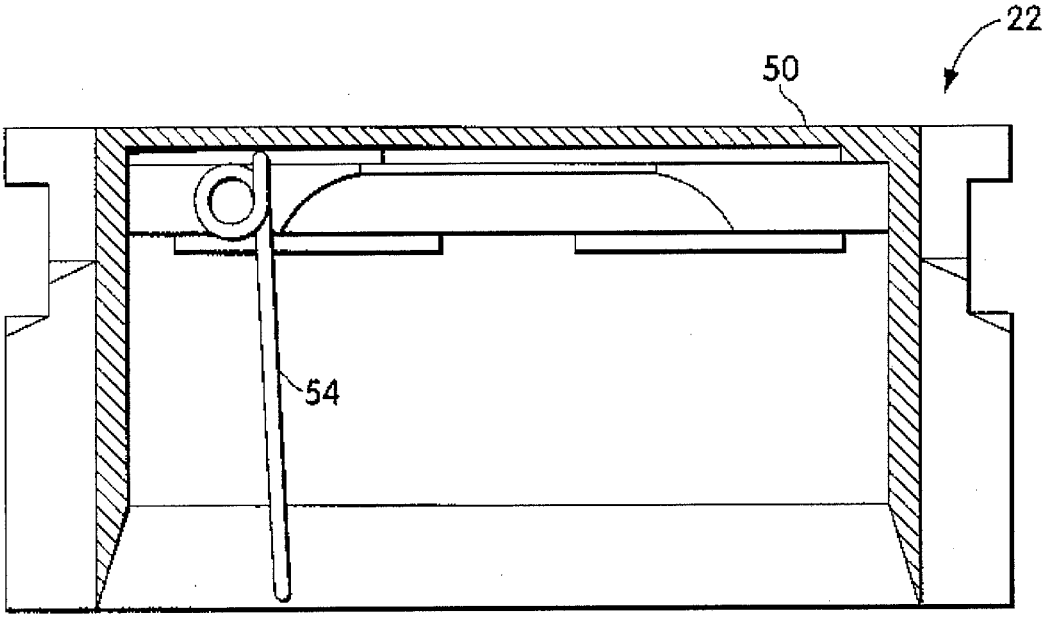
FIG. 3B is a side view in cross-section of the one-piece nose cup of FIG. 3A taken along line B—B.
Figure 4:
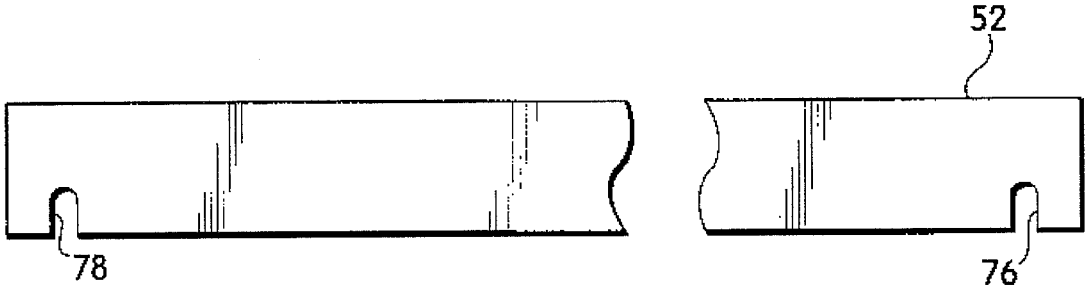
FIG. 4 is a diagram of the release band for use with the one-piece nose cup of FIGS. 3A–3F.
Figure 3C:
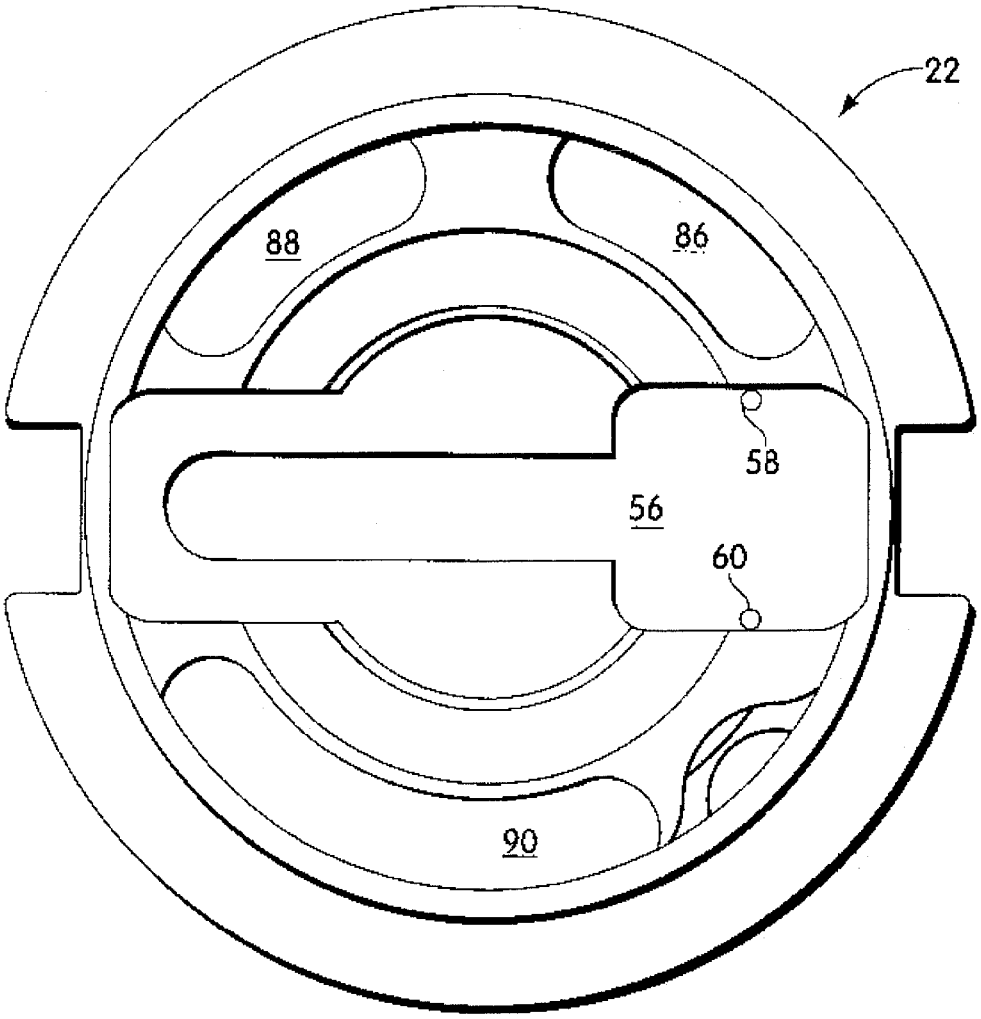
FIG. 3C is a bottom view of the one-piece nose cup of FIG. 3A.
Figure 5:
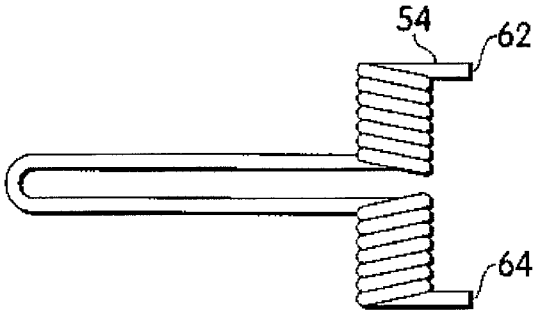
FIG. 5 is a diagram of a spring for use with the one-piece nose cup of FIGS. 3A–3F.
Figure 3D:
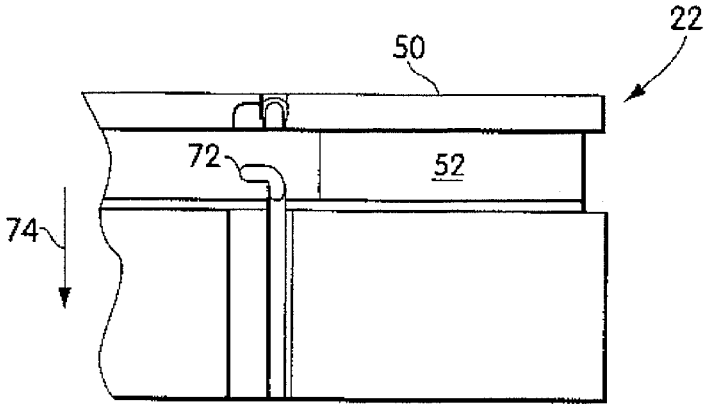
FIG. 3D is a partial side view of the one-piece nose cup of FIG. 3A taken along line D—D.
Figure 3E:
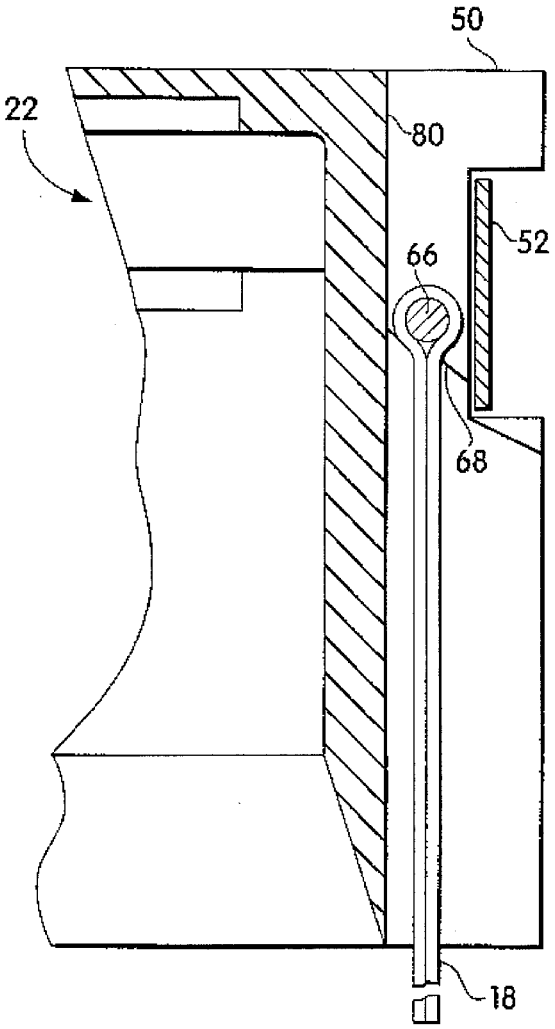
FIG. 3E is a side view in partial cross-section of the one-piece nose cup of FIG. 3A taken along line E—E, the side view including an air launch harness and a release band.

Referring to FIGS. 3A and 3E, the harness 18 attaches to the one-piece cup 22 as follows. A pin 66 at the end of each half of the harness 18 (only one half is shown in FIG. 3E) rests on a chamfered shelf 68 of the cup 22 and is held securely against a side 80 of the cup 22 by the release band 52. When the release band 52 is released from the cup 22, the pinned end of the harness 18 also releases and slides off of the chamfered shelf 68 and falls away (the other pinned end does the same thing) so that the harness 18 is no longer attached to the nose cup 22.

Figure 3F:
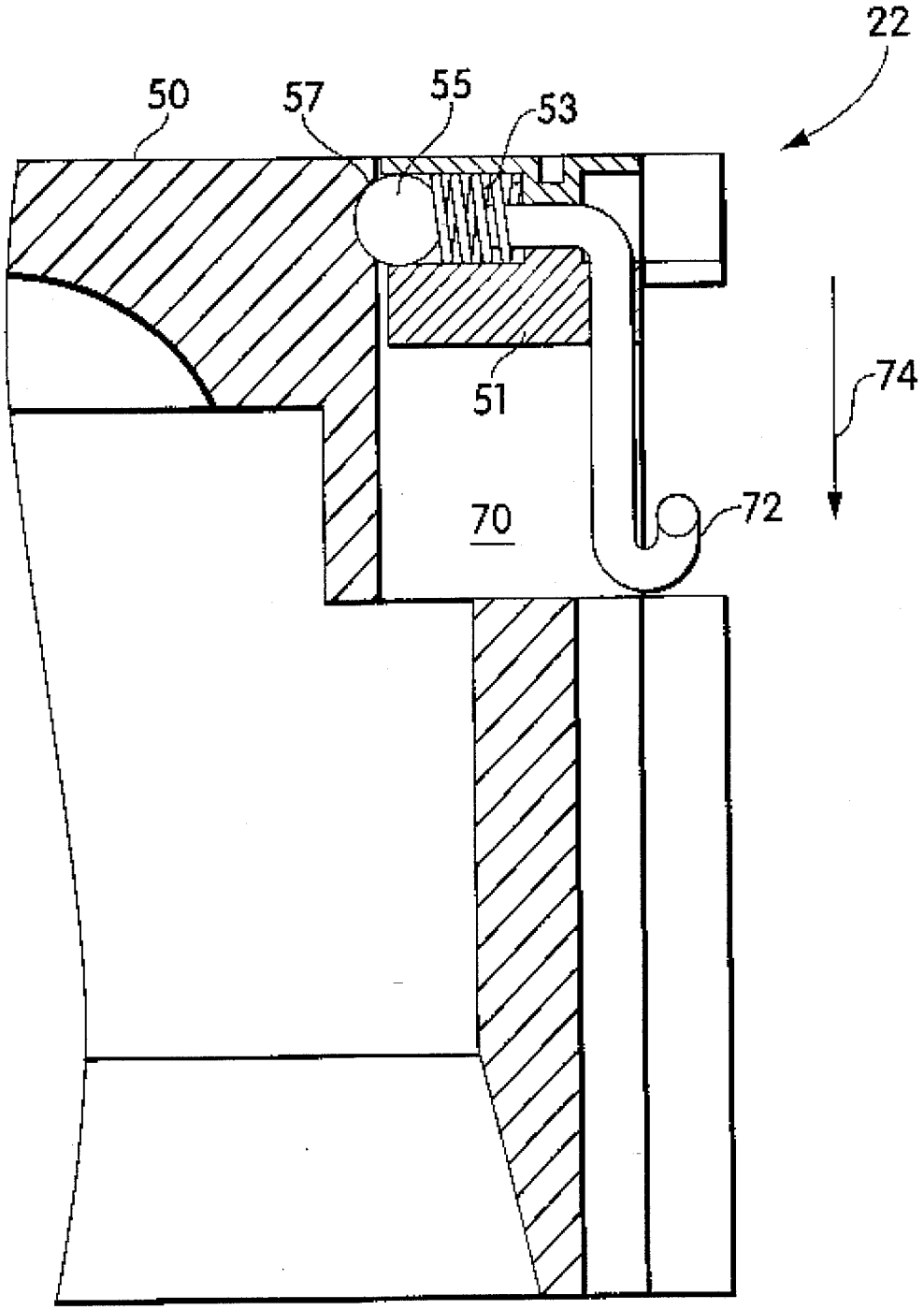
FIG. 3F is a side view in partial cross-section of the one-piece nose cup of FIG. 3A taken along line F—F, the side view including a plunger and a hook.

Referring to FIGS. 3A, 3D, and 3F, the release band 52 is released from the one-piece cup 22 as follows. A plunger 51 is slidable in a plunger hole 70 formed in the cup 22. When the plunger is depressed (e.g., due to the force of the water on the face 50 of the cup 22 when the cup 22 impacts the water), a hook 72 coupled to the plunger 51 moves in the same direction as the plunger 51 (the direction indicated by an arrow 74 in FIGS. 3D and 3E) and releases from two notches 76, 78 (FIG. 4) in the release band 52 thereby allowing the release band to spring away from the cup 22. The release band 52 is initially put in place by wrapping it around the cup 22 and overlapping the two ends of the release band 52 such that the notches 76, 78 line up at the location of the hook 72 and the plunger 51. The plunger 51 is then moved up (in the direction opposite of the direction indicated by the arrow 74), and the hook 72 enters the overlapping notches 76, 78 to hold the release band 52 releasably in place around the cup 22. In FIG. 3F, the plunger 51 and the hook 72 are shown in the non-depressed position in which the hook 72 is holding the release band 52 (not shown in FIG. 3F) in place. A ball and spring arrangement holds the plunger 51 in the non-depressed position of FIG. 3F. In this arrangement, a spring 53 pushes on a ball 55 and forces the ball 55 into a recess 57 in the cup 22 which holds the plunger 51 in the non-depressed position until, upon water impact, the force of the water on the face 50 of the cup 22 causes the plunger 51 to descend in the direction of the arrow 74.

The release band 52 preferably is made of spring steel although other strong, resilient materials also can be used. The face 50 of the cup 22 includes recessed slits 82, 84 for receiving a safety crossbar. The plunger 51 also includes a recessed slit on its top face, and this slit aligns with the slits 82, 84 in the cup 22 so that the safety crossbar lies flat across the face 50 of the cup 22 when in place. When installed in the slits 82, 84, the crossbar helps to prevent the plunger from being accidentally depressed by a person handling the cup 22 to prepare the vehicle 10 for an air or surface launch. A person cannot depress the plunger easily when the safety crossbar is in place. The safety crossbar does not, however, prevent or inhibit the plunger from being depressed when the face 50 of the cup 22 impacts the water.

As seen in FIGS. 3A and 3C, the cup 22 includes three water flow-through holes 86, 88, 90 in the disclosed embodiment. These holes, like the plunger hole 70, extend from the face 50 of the cup 22 through to the inside of the cup 22 where the nose 24 fits. The water flow-through holes allow water to flow freely through the cup 22, thus reducing any tendency for the cup 22 to "stick" to or stay attached to the nose 24 after the vehicle 10 has completed its initial entry dive and slowed to about five to ten miles per hour.

Figure 6:
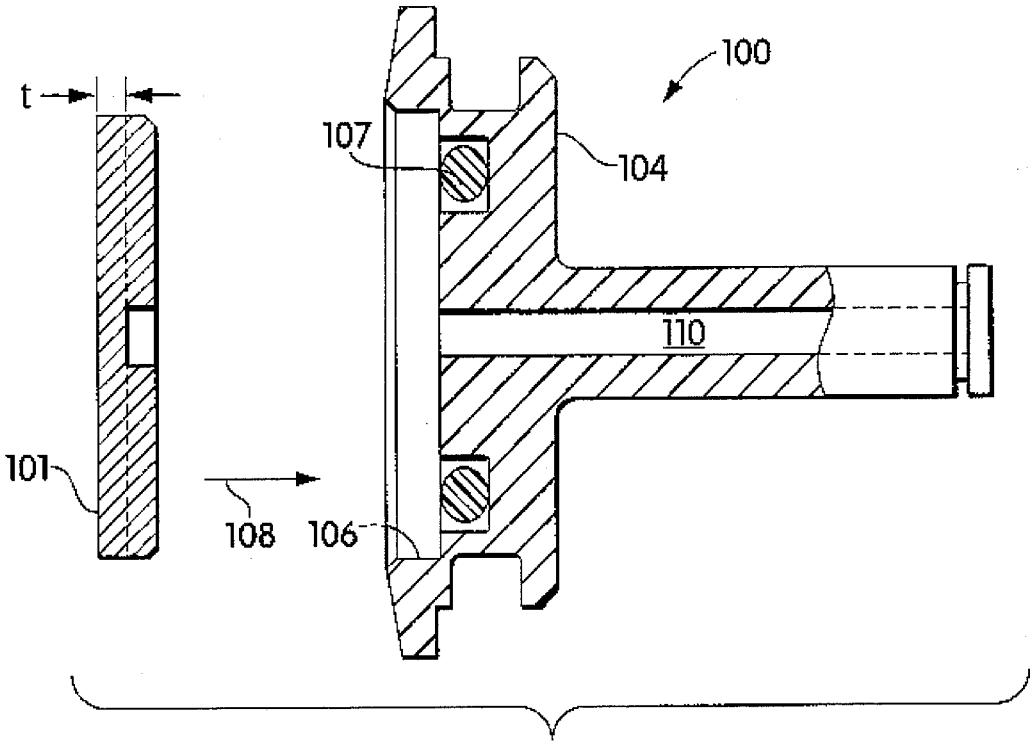
FIG. 6 is a side view in cross-section of a scuttle plug for use with the expendable underwater vehicle of FIG. 1 according to the invention.

Referring to FIGS. 1, 2, and 6, another aspect of the invention which makes the vehicle 10 useful in shallow ocean water operations involves a scuttle plug 100. The watertight compartment of the vehicle 10 which houses the motor 30, the guidance and control subsystem, the signal processing subsystem, and the battery pack 36 has a passage 102 thereinto via an existing vent plug. The passage 102 is formed in a bulkhead 105 located at approximately the center of the vehicle 10. The passage 102 is sealed with the scuttle plug 100 which includes a new vent plug 104 which incorporates a corrodible disk 101. The corrodible disk 101 fits into a recess 106 formed in the bottom of the vent plug 104 as indicated by an arrow 108. Once the corrodible disk 101 is placed into the recess 106, the combination of the corrodible disk 101 and the vent plug 104 (i.e., the scuttle plug 100) is inserted into the passage 102 to seal the compartment and make it watertight. The vent plug 104 has a central passage 110 therethrough. When the corrodible disk 101 is fitted into the recess 106 of the vent plug 104, the central passage 110 is blocked with an O-ring face seal 107 installed on the inner surface of the corrodible disk 101. When the vehicle 10 is in ocean water, the corrodible disk 101 corrodes away as a function of time, salinity, temperature, and pressure thereby allowing a hole through the disk 101 to form which allows the water to travel down the central passage 110 of the vent plug 104 and into the vehicle 10.

The vent plug 104 can be made from a variety of noble materials including aluminum, copper, and stainless steel (preferred). The corrodible disk 101 is made of an active material which corrodes after prolonged exposure to ocean water. Magnesium is the preferred material for the disk 101 although other materials are possible. In the disclosed embodiment, the thinnest portion of the disk 101 has a thickness, t, of 0.030 inches. In the disclosed embodiment, the disk 101 corrodes enough to allow water to enter and fill the formerly watertight compartment after an exposure period of between about six to seventy-two hours and, more particularly, after about twenty-four hours of exposure to the water. For a runtime (i.e., battery pack 36 life) of about three hours, the vehicle 10 will flood with water about twenty-one hours after the expended vehicle 10 drops to the bottom of the ocean. The exact time it takes for the disk 101 to corrode is a function of a number of factors including the type of corrodible material, the salinity of the water, the temperature of the water, and the pressure on the disk.

Use of the scuttle plug 100 with the vehicle 10 makes the vehicle 10 suitable for shallow water operations (i.e., operations in water having a depth of about 100 feet or less) because an expended vehicle filled with water is not likely to be washed onto the shore by the action of the tide and currents. An expended vehicle that is not filled with water and that is at the bottom of shallow ocean waters can be moved and washed onto the shore by the action of the tide and currents. Use of the scuttle plug 100 thereby reduces the likelihood of recovery of the expended vehicle and resultant exposure to the hazards associated with a partially discharged lithium battery. In addition, once the sea water is within the expended vehicle, the water depletes the energy of the battery, thereby further reducing the hazard associated with a partially discharged lithium battery in the event the expended vehicle is inadvertently recovered.

Figure 7A:
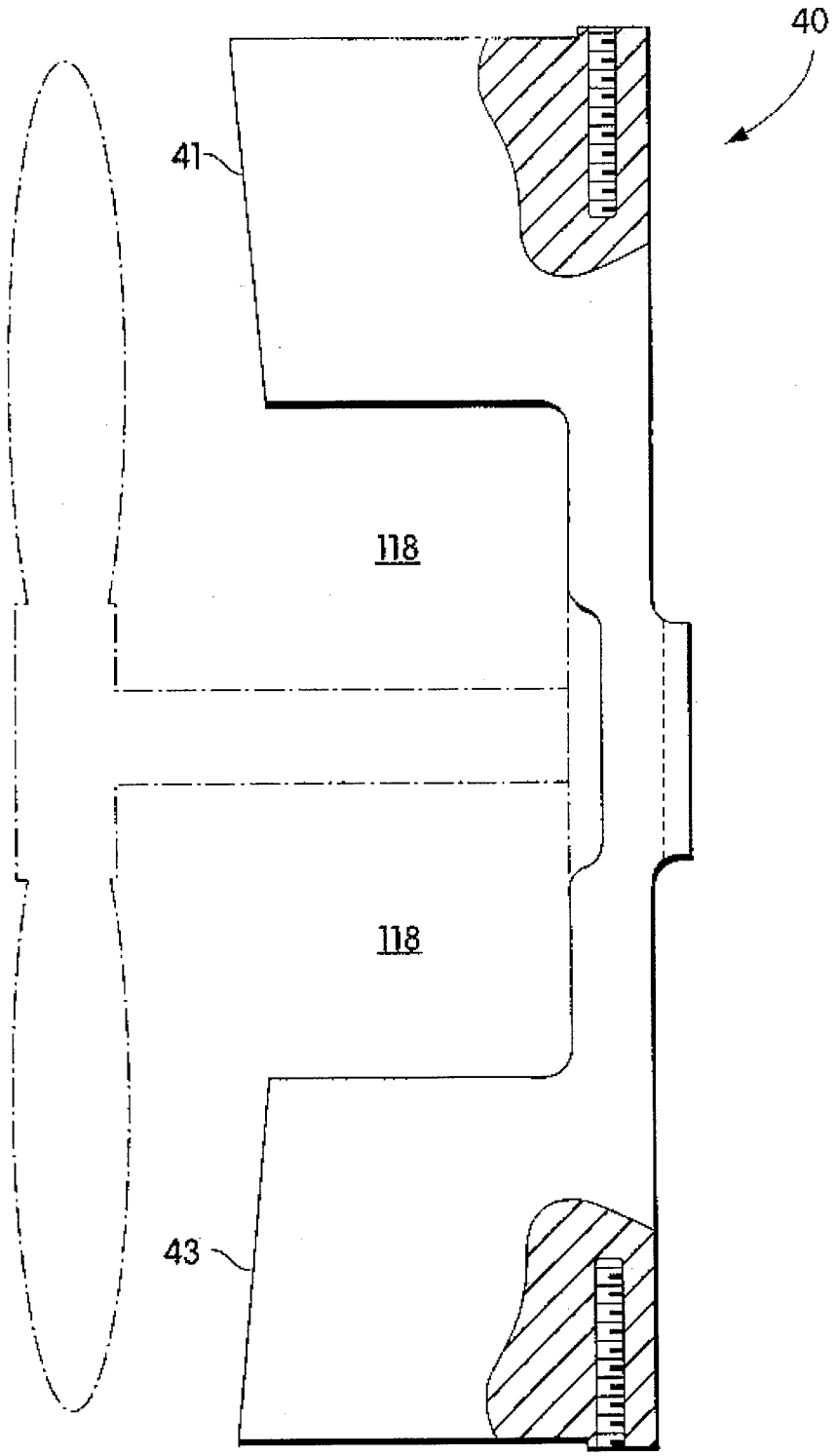
FIG. 7A is a side view in partial cross-section of rudders used in the expendable underwater vehicle of FIG. 1.
Figure 7B:
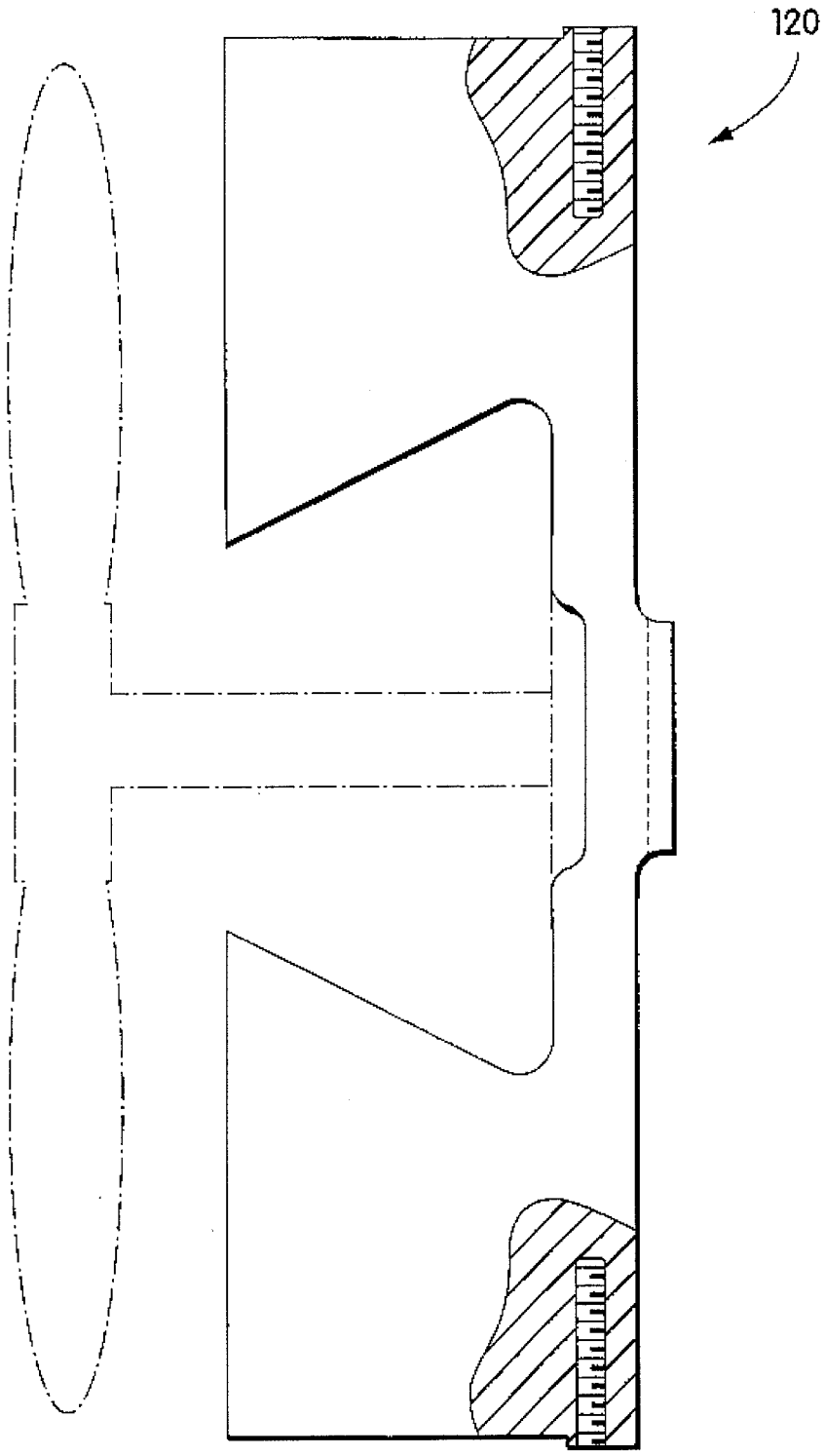
FIG. 7B is a side view in partial cross-section of an improved rudder for use in the expendable underwater vehicle of FIG. 1 according to the invention.

Referring to FIGS. 7A and 7B, another aspect of the invention which makes the vehicle 10 useful in shallow ocean water operations involves rudders and elevators with enlarged surface areas as compared to the surface areas of the rudders and elevators of a conventional EMATT. The rudders 40 of a conventional EMATT are shown in FIG. 7A. Each fin 41, 43 of the rudder 40 has a surface area of about 0.63 square inches, and thus the total rudder surface area is about 1.26 square inches. Note that this is the total rudder surface area for the surface shown and that the rudders 40 have opposite sides with the same total rudder surface area, making the overall surface area of the rudders 40 equal to about 2.52 square inches. While the elevators 38 of the conventional EMATT are not shown in FIG. 7A, they are similar in shape to the rudders 40, and thus the total elevator surface area (on one side thereof) also is about 1.26 square inches. Improved rudders 120 are shown in FIG. 7B. The improved rudders 120 take advantage of some unused space 118 in the conventional EMATT design by enlarging each of the fins such that it now extends into the unused space 118. The enlarged rudders 120 have a surface area which is about 24% greater than the surface area of the rudders 40 used in the conventional EMATT. More specifically, the total improved rudder surface area is about 1.56 square inches (on one side thereof), making the overall surface area of the enlarged rudders 120 equal to about 3.12. While the improved elevators are not shown in FIG. 7B, it should be understood that they are similar in shape to the improved rudders 120, and thus the total improved elevator surface area also is about 1.56 square inches (on one side thereof).

With the enlarged rudders and elevators, the controllability of the vehicle 10 in the water is greatly improved. In fact, when the enlarged rudders and elevators are used in the vehicle 10, they generally are able to overcome any out-of-straightness condition of the vehicle 10 which can result from air launch shocks and hydrostatic pressures. With the conventional rudders 40 and elevators 38 of FIG. 7A, the vehicle 10 cannot always overcome an out-of-straightness condition of the vehicle 10 thereby resulting in a loss of heading and/or depth control of the vehicle 10. These out-of-straightness conditions which can result from shocks due to air launching and/or hydrostatic pressures generally relate to the shape of the vehicle 10 along its longitudinal axis 28. That is, the out-of-straightness conditions are conditions where the shape of the vehicle 10 deviates from straight along its longitudinal axis 28. In general, the greater the deviation (i.e., the more severe the out-of-straightness condition), the less likely it is that the guidance and control subsystem of the vehicle 10 can keep the vehicle 10 on the preprogrammed course.

Variations, modifications, and other implementations of what is described herein will occur to those of ordinary skill in the art without departing from the spirit and the scope of the invention as claimed. Accordingly, the invention is to be defined not by the preceding illustrative description but instead by the following claims.

What is claimed is:

1. Apparatus for use in training naval forces in anti-submarine warfare in ocean water, comprising:

(A) an expendable underwater vehicle having a length of about three to five feet and a diameter of about five inches, the vehicle including:

a nose at a front end of the vehicle, a shroud at a rear end of the vehicle which includes a propeller, elevators, and rudders, an internal motor for driving the propeller, actuators for controlling the elevators and the rudders, an internal guidance and control subsystem for implementing a predetermined path for the vehicle in the ocean water by controlling the motor and the actuators to cause the vehicle to follow the path, an internal signal processing subsystem for simulating a submarine by generating signals representative of the submarine and causing corresponding acoustic signals to be transmitted into the ocean water, and an internal power source for powering the signal processing subsystem, the guidance and control subsystem, the motor, and the actuators; and (B) an expendable one-piece nose cup which fits over the nose of the vehicle and which is couplable to a parachute disposed at the rear end of the vehicle, the one-piece nose cup:

being fitted over the nose and coupled to the parachute prior to the air launching of the apparatus into the ocean water, including a face which impacts the ocean water before any other part of the apparatus after the apparatus is air launched, including means for decoupling the parachute therefrom upon impact with the ocean water, and releasing from the nose and dropping to the bottom of the ocean water when the vehicle reaches a depth therein of about 50 feet or less.

2. The apparatus of claim 1 wherein the decoupling means of the one-piece nose cup comprises:

a plunger disposed slidably within the nose cup;

a hook coupled to the plunger; and a release band wrapped releasably around the cup and held in place by the hook when the plunger is in a first position, the release band coupling the parachute to the cup;

the impact of the one-piece nose cup with the ocean water causing the plunger to slide to a second position which moves the hook and releases the release band thereby decoupling the parachute from the cup.

3. The apparatus of claim 2 wherein the one-piece nose cup further includes a spring disposed to push the cup away from the nose of the vehicle when the force of the spring together with the weight of the cup exceed the hydrodynamic force of the water on the cup as the vehicle slows down during its descent into the water.

4. The apparatus of claim 3 wherein the one-piece nose cup defines at least one opening extending from the face therethrough for allowing water to pass therethrough upon impact with the water.

5. The apparatus of claim 4 wherein the face of the one-piece nose cup defines a recess disposed adjacent the plunger for receiving a crossbar which inhibits movement of the plunger from the first position to the second position except upon impact of the one-piece nose cup with the ocean water.

6. The apparatus of claim 5 wherein the decoupling means further comprises a harness disposed between the parachute and the nose cup, the release band holding the harness to the nose cup when the plunger is in the first position, the nose cup defining a chamfered shelf on which a portion of the harness rests and is held in place when the plunger is in the first position, the portion of the harness sliding off of the chamfered shelf when the plunger slides to the second position.

7. The apparatus of claim 1:

wherein the vehicle further includes a watertight housing which houses the motor, the guidance and control subsystem, the signal processing subsystem, and the power source; and further comprising a scuttle plug which is disposed in the watertight housing and which includes a material which corrodes in the ocean water after the vehicle is expended such that the housing fills with the ocean water.

8. The apparatus of claim 7 wherein the scuttle plug comprises a vent plug and a corrodible disk, the corrodible disk being made of the material which comprises magnesium and the vent plug being made of a second material which comprises stainless steel.

9. The apparatus of claim 1 wherein the elevators and the rudders each has an overall surface area of at least about 2.6 square inches.

10. The apparatus of claim 9 wherein the overall surface area is about 3.12 square inches.

11. Apparatus for use in training naval forces in anti-submarine warfare in ocean water, comprising:

(A) an expendable underwater vehicle having a length of about three to five feet and a diameter of about five inches, the vehicle including:

a watertight housing, a nose at a front end of the housing, a shroud at a rear end of the housing which includes a propeller, elevators, and rudders, a motor inside the housing for driving the propeller, actuators outside the housing for controlling the elevators and the rudders, a guidance and control subsystem inside the housing for implementing a predetermined path for the vehicle in the ocean water by controlling the motor and the actuators to cause the vehicle to follow the path, a signal processing subsystem inside the housing for simulating a submarine by generating signals representative of the submarine and causing corresponding acoustic signals to be transmitted into the ocean water, and a power source inside the housing for powering the signal processing subsystem, the guidance and control subsystem, the motor, and the actuators; and (B) a scuttle plug which is disposed in the watertight housing of the vehicle and which includes a material which corrodes in the ocean water after the vehicle is expended such that the housing fills with the ocean water.

12. The apparatus of claim 11 wherein the scuttle plug comprises a vent plug and a corrodible disk, the corrodible disk being made of the material which comprises magnesium and the vent plug being made of a second material which comprises stainless steel.

13. The apparatus of claim 11 further comprising:

an expendable one-piece nose cup which fits over the nose of the vehicle and which is couplable to a parachute disposed at the rear end of the vehicle, the one-piece nose cup:

being fitted over the nose and coupled to the parachute prior to the air launching of the apparatus into the ocean water, including a face which impacts the ocean water before any other part of the apparatus after the apparatus is air launched, including means for decoupling the parachute therefrom upon impact with the ocean water, and releasing from the nose and dropping to the bottom of the ocean water when the vehicle reaches a depth therein of about 50 feet or less.

14. The apparatus of claim 13 wherein the decoupling means of the one-piece nose cup comprises:

a plunger disposed slidably within the nose cup;

a hook coupled to the plunger; and a release band wrapped releasably around the cup and held in place by the hook when the plunger is in a first position, the release band coupling the parachute to the cup;

the impact of the one-piece nose cup with the ocean water causing the plunger to slide to a second position which moves the hook and releases the release band thereby decoupling the parachute from the cup.

15. The apparatus of claim 14 wherein the one-piece nose cup further includes a spring disposed to push the cup away from the nose of the vehicle when the force of the spring together with the weight of the cup exceed the hydrodynamic force of the water on the cup as the vehicle slows down during its descent into the water.

16. The apparatus of claim 15 wherein the one-piece nose cup defines at least one opening extending from the face therethrough for allowing water to pass therethrough upon impact with the water.

17. The apparatus of claim 16 wherein the face of the one-piece nose cup defines a recess disposed adjacent the plunger for receiving a crossbar which inhibits movement of the plunger from the first position to the second position except upon impact of the one-piece nose cup with the ocean water.

18. The apparatus of claim 17 wherein the decoupling means further comprises a harness disposed between the parachute and the nose cup, the release band holding the harness to the nose cup when the plunger is in the first position, the nose cup defining a chamfered shelf on which a portion of the harness rests and is held in place when the plunger is in the first position, the portion of the harness sliding off of the chamfered shelf when the plunger slides to the second position.

19. The apparatus of claim 11 the elevators and the rudders each has an overall surface area of at least about 2.6 square inches.

20. The apparatus of claim 19 wherein the overall surface area is about 3.12 square inches.

21. Apparatus for use in training naval forces in anti-submarine warfare in ocean water, comprising:

an expendable underwater vehicle having a length of about three to five feet and a diameter of about five inches, the vehicle including:

a nose at a front end of the vehicle, a shroud at a rear end of the vehicle which includes a propeller, elevators, and rudders, the elevators and the rudders each having an overall surface area of at least about 2.6 square inches, an internal motor for driving the propeller, actuators for controlling the elevator and the rudders, an internal guidance and control subsystem for implementing a predetermined path for the vehicle in the ocean water by controlling the motor and the actuators to cause the vehicle to follow the path, an internal signal processing subsystem for simulating a submarine by generating signals representative of the submarine and causing corresponding acoustic signals to be transmitted into the ocean water, and an internal power source for powering the signal processing subsystem, the guidance and control subsystem, the motor, and the actuators.

22. The apparatus of claim 21 wherein the overall surface area is about 3.12 square inches.

23. The apparatus of claim 21:

wherein the vehicle further includes a watertight housing which houses the motor, the guidance and control subsystem, the signal processing subsystem, and the power source; and further comprising a scuttle plug which is disposed in the watertight housing and which includes a material which corrodes in the ocean water after the vehicle is expended such that the housing fills with the ocean water.

24. The apparatus of claim 23 wherein the scuttle plug comprises a vent plug and a corrodible disk, the corrodible disk being made of the material which comprises magnesium and the vent plug being made of a second material which comprises stainless steel.

25. The apparatus of claim 21 further comprising:

an expendable one-piece nose cup which fits over the nose of the vehicle and which is couplable to a parachute disposed at the rear end of the vehicle, the one-piece nose cup:

being fitted over the nose and coupled to the parachute prior to the air launching of the apparatus into the ocean water, including a face which impacts the ocean water before any other part of the apparatus after the apparatus is air launched, including means for decoupling the parachute therefrom upon impact with the ocean water, and releasing from the nose and dropping to the bottom of the ocean water when the vehicle reaches a depth in the ocean water of about 50 feet or less.

26. The apparatus of claim 25 wherein the decoupling means of the one-piece nose cup comprises:

a plunger disposed slidably within the nose cup;

a hook coupled to the plunger; and a release band wrapped releasably around the cup and held in place by the hook when the plunger is in a first position, the release band coupling the parachute to the cup;

the impact of the one-piece nose cup with the ocean water causing the plunger to slide to a second position which moves the hook and releases the release band thereby decoupling the parachute from the cup.

27. The apparatus of claim 26 wherein the one-piece nose cup further includes a spring disposed to push the cup away from the nose of the vehicle when the force of the spring together with the weight of the cup exceed the hydrodynamic force of the water on the cup as the vehicle slows down during its descent into the water.

28. The apparatus of claim 27 wherein the one-piece nose cup defines at least one opening extending from the face therethrough for allowing water to pass therethrough upon impact with the water.

29. The apparatus of claim 28 wherein the face of the one-piece nose cup defines a recess disposed adjacent the plunger for receiving a crossbar which inhibits movement of the plunger from the first position to the second position except upon impact of the one-piece nose cup with the ocean water.

30. The apparatus of claim 29 wherein the decoupling means further comprises a harness disposed between the parachute and the nose cup, the release band holding the harness to the nose cup when the plunger is in the first position, the nose cup defining a chamfered shelf on which a portion of the harness rests and is held in place when the plunger is in the first position, the portion of the harness sliding off of the chamfered shelf when the plunger slides to the second position.

31. The apparatus of claim 7 wherein the elevators and the rudders each has an overall surface area of at least about 2.6 square inches.

32. The apparatus of claim 31 wherein the overall surface area is about 3.12 square inches.

33. The apparatus of claim 9:

wherein the vehicle further includes a watertight housing which houses the motor, the guidance and control subsystem, the signal processing subsystem, and the power source; and further comprising a scuttle plug which is disposed in the watertight housing and which includes a material which corrodes in the ocean water after the vehicle is expended such that the housing fills with the ocean water.

34. The apparatus of claim 33 wherein the scuttle plug comprises a vent plug and a corrodible disk, the corrodible disk being made of the material which comprises magnesium and the vent plug being made of a second material which comprises stainless steel.

* * * * *